US006312174B1

(12) United States Patent
Drynkin et al.

(10) Patent No.: US 6,312,174 B1
(45) Date of Patent: Nov. 6, 2001

(54) THERMAL PRINTER FOR COMPACT DISKS

(75) Inventors: Alexander V. Drynkin, Walnut Creek; David B. Miller, Orinda, both of CA (US)

(73) Assignee: Wordtech Systems, Inc., Concord, CA (US)

( * ) Notice: Subject to any disclaimer, the term of this patent is extended or adjusted under 35 U.S.C. 154(b) by 0 days.

(21) Appl. No.: 09/191,307

(22) Filed: Nov. 13, 1998

(51) Int. Cl.[7] ..... B41J 2/315

(52) U.S. Cl. ..... 400/120.16; 400/48; 400/70; 101/35

(58) Field of Search ..... 400/120.16, 120.17, 400/279, 70, 73, 23, 27, 28, 59, 48, 525, 528, 529, 530, 539, 540; 101/35, 41

(56) References Cited

U.S. PATENT DOCUMENTS 5,317,337 * 5/1994 Ewaldt ..... 346/1.1
5,518,325 * 5/1996 Kahle ..... 400/70
5,542,768 * 8/1996 Rother et al. ..... 400/120.16
5,797,688 * 9/1998 Wen ..... 400/48
5,915,858 * 6/1999 Wen ..... 101/35 X
5,927,208 * 7/1999 Hagstrom et al. ..... 101/486
5,967,676 * 10/1999 Cutler et al. ..... 400/70

* cited by examiner

*Primary Examiner*—John S. Hilten
*Assistant Examiner*—Minh H. Chau
(74) *Attorney, Agent, or Firm*—Richard Esty Peterson

(57) ABSTRACT

A thermal transfer printer having a print head and a media support platform that is displaced relative to the print head, the media support platform having a rigid support surface for a media item having a non-rectangular configuration such as a compact disk, the support platform having a mask with a cutout substantially in the shape of the non-rectangular disk, the mask and media item combining to form a contact surface for the print head to uniformly distribute a constant force of the print head in a uniform pressure across the mask and media item during printing, the mask providing, in addition, a holding apparatus for the media item which is contacted by a displaceable retainer pin urging the media item against the edge of the mask with the print head avoiding contact with the retainer pins on the printing area, the printer having a mechanism to displace the retainer pin and sense whether a media item is properly placed in the cutout and retained by the retaining apparatus.

10 Claims, 5 Drawing Sheets

THERMAL PRINTER FOR COMPACT DISKS

BACKGROUND OF THE INVENTION

This invention relates to a thermal transfer printer for printing on the surface of a compact disk, particularly a recordable compact disk known as a CD-R disk.

The invention optimizes printing on irregularly shaped media and incorporates features to prevent damage to the thermal transfer print head.

Compact disks are an inexpensive medium for storing digital information that may relate to audio, video and/or any type of information or data that is conveniently stored in digital form. When compact-disks are manufactured in large quantities, the side opposite the recording side of the disk is customarily printed in a mass printing process such as silk screening. The label information applied to the disks is generally identical for each disk and related to the pre-recorded content of the disks.

With the development of the CD-R disk, disks can be sold in blank with the informational content later recorded by a CD-R recorder. In order to appropriately label such disks with regard to the content that is recorded on the disk, programmable disk printers, such as ink jet printers and thermal transfer printers have been devised. These printers print the surface of the disk with graphics and other information that can be customized to correspond to the information recorded on the disk by the CD-R recorder. One drawback in using an inkjet printer is the extended time required to print an individual disk. Another drawback is the additional expense of disk blanks which require a precoated surface for inkjet printing.

Thermal transfer printers can print with greater speed and print on disk blanks prepared with an inexpensive lacquer coating. Thermal transfer printers include a print head that applies a contact pressure to the media to be printed.

One type of thermal transfer printer will typically consist of a mechanism that has a stationary print head, a ribbon, and assembly that moves the media under the print head. The print head contains an array of heating elements. The ribbon is a plastic film with a wax or resin compound deposited on one side. The print head is in contact with the ribbon during printing, and the ribbon is in contact with the media.

By heating the areas of the ribbon, the wax or resin compound is deposited on the media. Printing occurs by moving ribbon and the media at the same rate across the print head, while firing the heating elements in a desired pattern. The print head must exert some pressure on the media for successful transfer of the wax or resin to the media.

A second type of thermal printer is a direct transfer printer, which uses thermally sensitive media that changes color when heated, therefore a ribbon is not required. With thermally sensitive media, the print head marks the media by generating a pattern of heated and non-heated areas on the surface of the media, as it moves under the print head. The invention described is applicable to-both types of thermal printers.

Thermal transfer printers require the print head to contact the printable surface at a uniform pressure for optimum transfer of wax or resin from a ribbon to the media (or heat in the case of direct thermal transfer printer). Variations in print head pressure to the media result in improper printing on media such as non-printed areas or uneven print density.

Printing on rectangular objects, such as a piece of paper is relatively straight forward, since the print head pressure remains constant during the entire printing process. The pressure remains constant because the area of contact between the print head and the media does not change. For example, in printing a 5" wide piece of paper the print head is always in contact with 5" of media. In contrast, printing on an 5" diameter disk, the area of contact would initially be very small as the print head is at the edge of the disk, but then increases to 5" as the print head crosses the center of the disk. After crossing the center of the disk, the area of contact decreases as the print head travels the far edge of the disk.

When the force of the print head applied to the media is constant and the print head travels across a rectangular shaped media, the pressure per unit area is constant. If the print head travels across a disc shaped media, the print head pressure to the media will change as the print head travels across the disc. When the force of the print head applied to the media is constant and the print head travels across a disk shaped media the pressure per unit area changes as the contact area increases and decreases.

To successfully, print on disc shape media, the printer must be constructed to either:

a) vary the force of the print head applied to the media as it travels across the disc to compensate for the variation in width of printable surface, or b) hold the disc in a manner that effectively presents an unchanging width of contact area for the print head as it moves across the disc.

The process described in point a) can be achieved by using a complicated system of cams, gears, and sensors.

The process described in point b) can be achieved by using a simple system based on the invention that incorporates a media holding tray that puts the print head in contact with the media and a supplemental surface. The combination of the surfaces which are in contact with the print head present a surface of uniform width (width that does not change as the disc is printed). This supplemental surface comprises a mask, that has a thickness and structural characteristics that are substantially the same as the media.

The invention described below consists of a thermal printer that utilizes a tray type of media holder with materials arranged in such a manner as to maintain a uniform print head pressure to media as the media moves relative to the print head.

The media to be printed is placed in the media tray which consists of a base layer of compressible material (mounted on either a platform or platen) and a second mask layer of material similar to the thickness and composition of the media. The mask layer has a cutout in which the media is positioned. This arrangement allows the printable surface of the media to be at the same level as the unmasked areas of the compressible surface.

The key feature of this arrangement is that as the print head passes over the media, the area of contact between the print head and the sum of the areas of the media and the surface of the media holder remains constant. This results in uniform (unchanging) print head pressure on the media during the entire printing process.

By careful selection of the materials of the media holder, the proper print head to media pressure can be maintained without the use of complex print head pressure control systems. In addition, proper print head pressure can be maintained when printing odd shaped, non-rectangular media, such as disc shaped objects, where the print head's area of contact with the media varies as the print head moves relative to the disc.

The base layer (compressible surface) and the mask layer (surface with cutout area in the shape of the media) may have one of more layers of material, so long as the surface of the mask layer has similar mechanical characteristics to the item being printed.

A typical composition of the base layer would consist of a material that compresses to the appropriate degree needed to maintain proper print head pressure distribution on the media. The preferred embodiment for the disc printing application would require a base layer material that has a compression value of 40–70 durometer which could include materials such as neoprene and other rubber-like substances.

A typical configuration of the mask layer would consist of a material that does not compress or has the same compression characteristics as the media. The preferred material for the mask layer of the disc printing application is a non-compressible material such as polycarbonate. CD-ROM and CD-R discs are typically made from molded polycarbonate.

SUMMARY OF THE INVENTION

The thermal transfer printer of this invention is designed to print on non-rectangular media, and in particular, on disk-shaped media, such as a compact disk. The invented printer resolves the problem of printing with a uniform pressure across irregular-shaped media.

The thermal transfer printer of this invention includes a carrier having a flat media support surface with a resilient base layer and a top mask layer. The top mask layer has a media mask with a cutout having a configuration that matches the configuration of the media item to be printed. The media mask is fabricated from a material having physical and structural characteristics that are substantially the same as the media item being printed. Additionally, the media mask has a thickness that matches the thickness of the media item.

In this manner, the thermal contact element in the print head of the thermal transfer printer distributes its contact force across both the media item and the mask. The resulting pressure per unit area applied to the media item thereby remains constant during each advance of the carrier relative to the contact edge of the print head.

Additionally, the thermal transfer printer of this invention includes an improved retaining mechanism to retain a media item in position during the printing process. The retaining mechanism is designed to avoid damage to the fragile thermal resistors forming the linear array of pixel generating elements in the contact edge of the print head.

The retaining mechanism includes a retainer pin that is activated to hold the media item against the edge of the media mask. In the case of a compact disk having a circular perimeter, the mask includes two small edge protuberances that project into the complimentary circular-shaped cutout area of the mask layer opposite the retainer pin. The pin is activated against the edge of the disk to urge the disk against the protuberances, thereby positioning the disk on the centerline between the protuberances.

This arrangement avoids the use of multiple contact pins that may damage the fragile pixel generating elements in the contact edge of the thermal print head. Furthermore with this system, the printer is able to place the contact edge of the print head at the leading edge of the disk just behind the single disk holding pin. This allows the disk to be printed with no chance of collision between the media holding pin and the print head.

The invented transfer printer also includes a mechanism to detect the carrier position and detect whether a media item is properly positioned on the carrier before contact by the print head. The detection mechanism is incorporated into the preferred actuatable retainer mechanism to hold the media item in place during printing. Other embodiments of a retaining means include non-conductive pins and pins with curved or chamfered profiles which are utilized to avoid damage during inadvertent contact with the thermal contact edge of the print head. These and other features are described in greater detail in the detailed description of the preferred embodiments that follows.

DETAILED DESCRIPTION OF THE PREFERRED EMBODIMENTS

Figure 1:
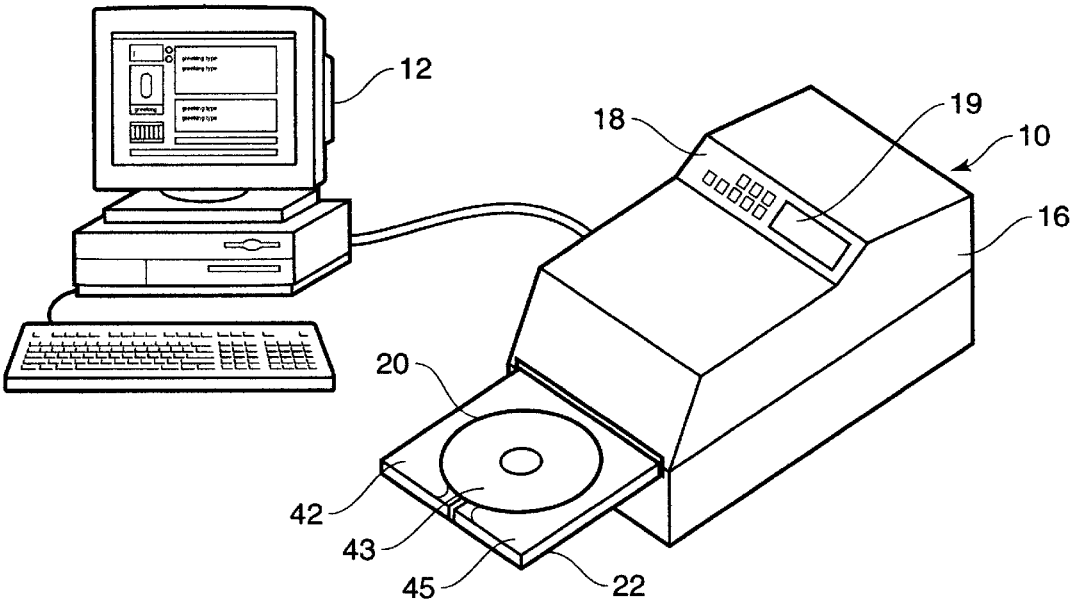
FIG. 1 is a perspective view of the thermal printer and a personal computer, the printer having an extended tray with a compact disk in the tray.

The thermal transfer printer of this invention is shown in one preferred embodiment in FIG. 1, and is designated generally by the reference numeral 10. The thermal transfer printer 10, hereafter, thermal printer, is shown coupled to a general purpose computer 12 by a cable 14. The general purpose computer 12 conveniently carries an application program to create and manage graphic images and text that are to be transferred to the media by the thermal printer 10. An ordinary personal computer is typically adequate for creating labels for compact disks, the primary use for which this printer was invented.

The thermal printer 10 has an external casing 16 with a control panel 18 for entry of user commands and a display 19 for display of user entries and prompts generated by the printer 10. Within the thermal printer 10 is housed a controller 11, shown in FIG. 3, that coordinates the electronic and mechanical operations involved in the automated printing of a media item. The preferred media item is a recordable compact disk 20 shown in the extended media holding tray 22 of the preferred embodiment. The thermal transfer printer of this invention is designed to print on non-rectangular-shaped media and is particularly adapted to print label information on compact disks. The embodiment described utilizes a ribbon having a thermally sensitive transfer coating that is transferred from the ribbon to the media when heated by a print head.

Figure 2:
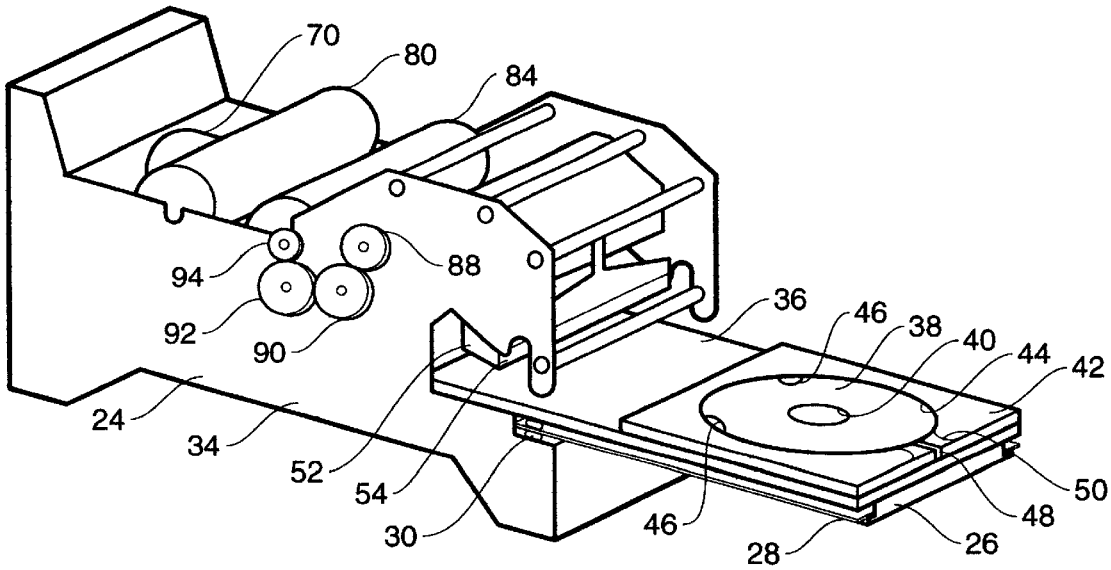
FIG. 2 is a perspective view of the thermal printer with the casing removed and the tray extended.
Figure 4:
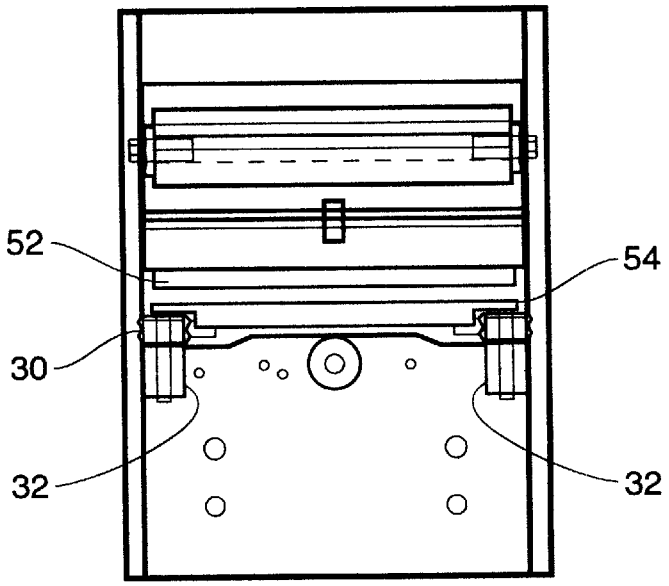
FIG. 4 is a partial end view showing the support mechanism for the tray.

Referring to the perspective view of FIG. 2 with the external housing 16 removed, the media tray 22 is shown fully extended from a housing frame 24. The media tray 22 has a carriage 26 with side rails 28 that engage rollers 30 mounted on internal journal brackets 32 fixed to the side walls 34 of the frame 24 as shown in FIG. 4. The portion of the media tray that is extended external to the housing frame 24 comprises a media support platform 35 having a flat, rigid top surface.

Mounted on the top surface 36 of the tray 22 is a rectangular resilient pad 38 with a center cutout 40. On top of the resilient pad 38 is a mask 42 having a rectangular perimeter with a substantially circular cutout 44 that approximately conforms to the circular perimeter of the recordable compact disk 20 of FIG. 1. The mask 42 has a thickness equal to the compact disk 20 and has similar physical and structural characteristics, preferably being fabricated of poly-carbonate, the same material as the disk. The circular cutout 44 has two edge protuberances 46 (exaggerated in FIG. 2) spaced about 45° apart to center a disk when deposited in the circular cutout 44 of the mask 42. The cutout 40 of the resilient pad 38 allows the disk 20 to seat flat on the pad 38 by accommodating an annular ridge around the centerhole of a typical compact disk. When seated in the cutout of the mask, the top surface 43 of the disk 20 is at the same level as the top surface 45 of the mask 42.

The circular cutout 44 of the mask 42, the pad 38 and the end of the tray 22 have a slot 48 to accommodate a displaceable retainer pin 50. The pin 50 engages the edge 51 of a disk that is deposited manually or mechanically in the circular cutout 44 and holds the disk against the protuberances 46 during printing.

The flat tray 22 forms a rigid support surface, the resilient pad of uniform thickness forms a base layer and the mask forms a mask layer, which layer includes the combination of the mask and a flat media item when printing. The base layer is constructed of a rubber-like material such as neoprene sheet of 40–70 durometer hardness. The base layer is approximately one-eighth inch in thickness and allows for uniform distribution of forces across the printing edge of a print head. The material forming the mask 42 in the mask layer is relatively non-compressible and has physical and structural characteristics that match the non-rectangular contour of the media item. In the case of a recordable compact disk that is relatively non-compressible and stiff, with only a limited degree of flexibility, the mask in the mask layer must have similar characteristics, since the local pressure of the print head is distributed over an expanded area of the base layer by the relatively rigid components forming the mask layer. The mask 42 has the same thickness and preferably the same composition as the media item.

Figure 9:
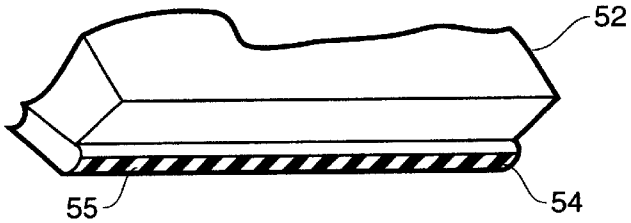
FIG. 9 is a schematic view of a print head contact edge.

Printing is accomplished by a thermal print head 52 having an elongated contact edge 54. Along the length of the contact edge are pixel generating elements 55, shown schematically in FIG. 9. The elongated contact edge 54 has a length and a narrow width that distributes the force applied to the print head across the surface contacted. The pixel generating elements 55 include a line of thermal resistors (not shown) that are selectively activated to cause the transfer of discrete spots of wax on resin ink from a coated ribbon 78 to the media. The discrete spots form the print pixels of the bit-mapped label image. The composite of the label image is formed in lines as a sequence of linear print segments. The media is advanced relative to the print head in steps that are the width of the pixel elements to form the next linear segment of print. Contact of the print head with the media is direct in the case of a media item having a thermally activateable coating, or indirect in the case where a ribbon coated with a thermal transfer coating is interposed between the print head and the media.

The print head of the preferred embodiment includes over 1500 pixel generating elements in a linear array approximately five inches in length. The print head 52 is pressed firmly against a media item with the ribbon 78 interposed between the contact edge 54 and the media item. When the force of the print head 52 against the media item is constant, and the number of pixel generating elements in contact with the media item is the same for each line of printing, the printing is uniform.

However, if the number of pixel generating elements in contact with the media item changes from one line to the next, for example, when printing a non-rectangular media item such as a compact disk, then the printing, which is pressure dependent, will become uneven. Printing at the edge of a disk distributes the force of the head over a lesser number of pixel elements than printing at the center of the disk where a greater number of pixel elements are in contact with the disk.

To maintain a constant print pressure per unit area over a non-rectangular shaped media item, the media compatible mask 42 is used. The mask plus the media item presents a combined contact surface to the contact edge of the print head that is designed to be substantially uniform with a constant width for each linear segment of printing.

Although the entire length of the contact edge 54 of the print head need not contact the media item and mask, the portion of the contact edge in contact with the combined surfaces of the media item and mask must remain substantially constant for uniform printing. As shown in FIG. 1, the top surface 43 of the disk 20 plus the top surface 45 of the mask 42 form a combined surface that is rectangular. The sum of the mask surface 45 and the media surface 43 in contact with the contact edge of the print head is thereby constant for each linear segment of printing as the tray is displaced during the printing operation.

Figure 3:
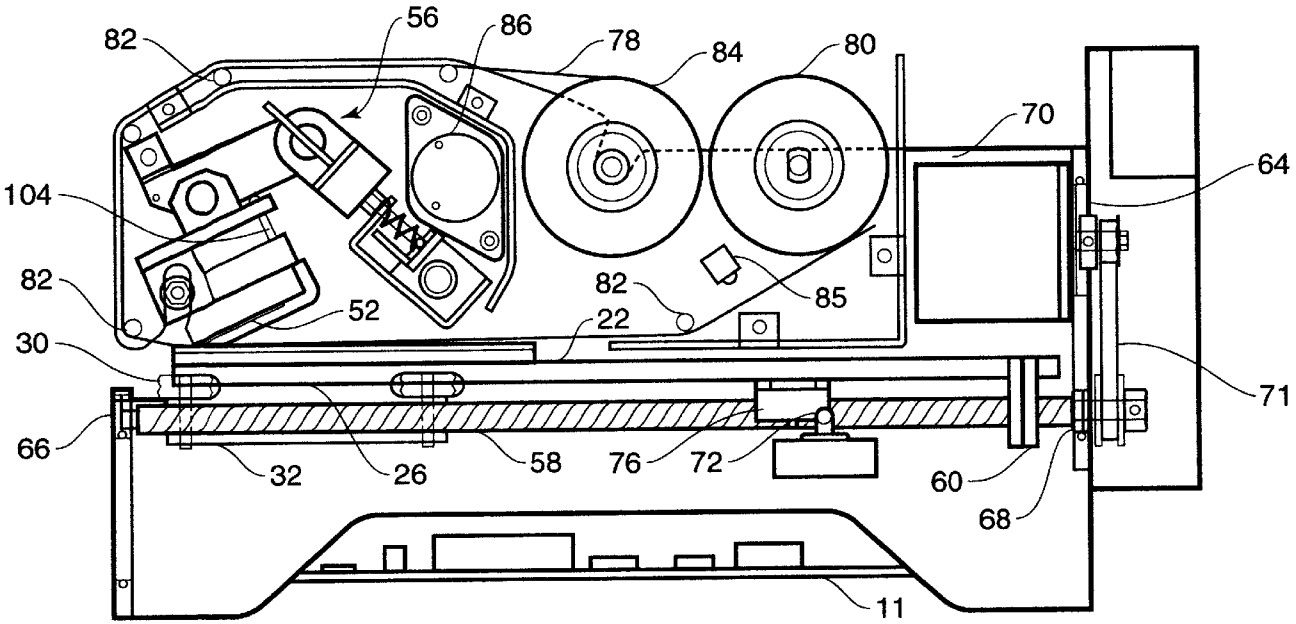
FIG. 3 is a side sectional view of the thermal printer showing the internal components of the printer with the tray retracted.

Referring to FIG. 3, the media holding tray 22 is shown retracted by action of a lead screw 58, which is connected to the carriage 26 and holding tray 22 by a lead screw nut 60. The lead screw 58 is mounted in end walls 62 and 64 in bearings 66 and 68. A stepping motor 70 connected to a timing belt assembly 71 rotates the lead screw 58 in counted pulses and precisely controls the linear displacement and location of the carriage 26 and the tray 22. A photosensor 72 on a bracket 74 mounted to the frame 24 detects a flag 76 depending from the underside of the carriage 26 to mark a "home position." This reference is used by a control program in the controller 11 for determining the precise tray position to sequence the various print operations including raising and lowering of the print head 52.

The print head 52 presses firmly against the media layer with a force ranging from 5–12 pounds. Even when fully distributed across the entire contact edge 54, there is an applied force of over a pound per linear inch along the edge 54. Contact with a disk holding pin can easily damage the fragile thermal resistors of the pixel generating elements 55. The retaining pin 50 is preferably located outside the area of printing. Use of the single pin 50 in conjunction with the protuberances 46 on the mask 42 avoids contact with the pin, since the print head 52 is lowered with precision onto the disk 20 and mask 42 adjacent the pin and prints with movement away from the pin.

The thermal transfer medium is coated on the ribbon 78 carried on a supply roll 80. The ribbon 78 is passed around perimeter guide rods 82 and under the print head 52 to a takeup roll 84. A photosensor 85 detects the presence of the ribbon 78 and signals the controller when the end of the ribbon is reached. A drive motor 86 has a drive gear 88 that engages a pair of gears 90 and 92 in a gear train, with gear 92 engaging a spindle gear 94 for the takeup roll 84, as shown in FIG. 2. The drive motor 86 takes up the ribbon during printing as the print head 52 presses the ribbon against the media and mask on the moving media holder tray 22.

Figure 6:
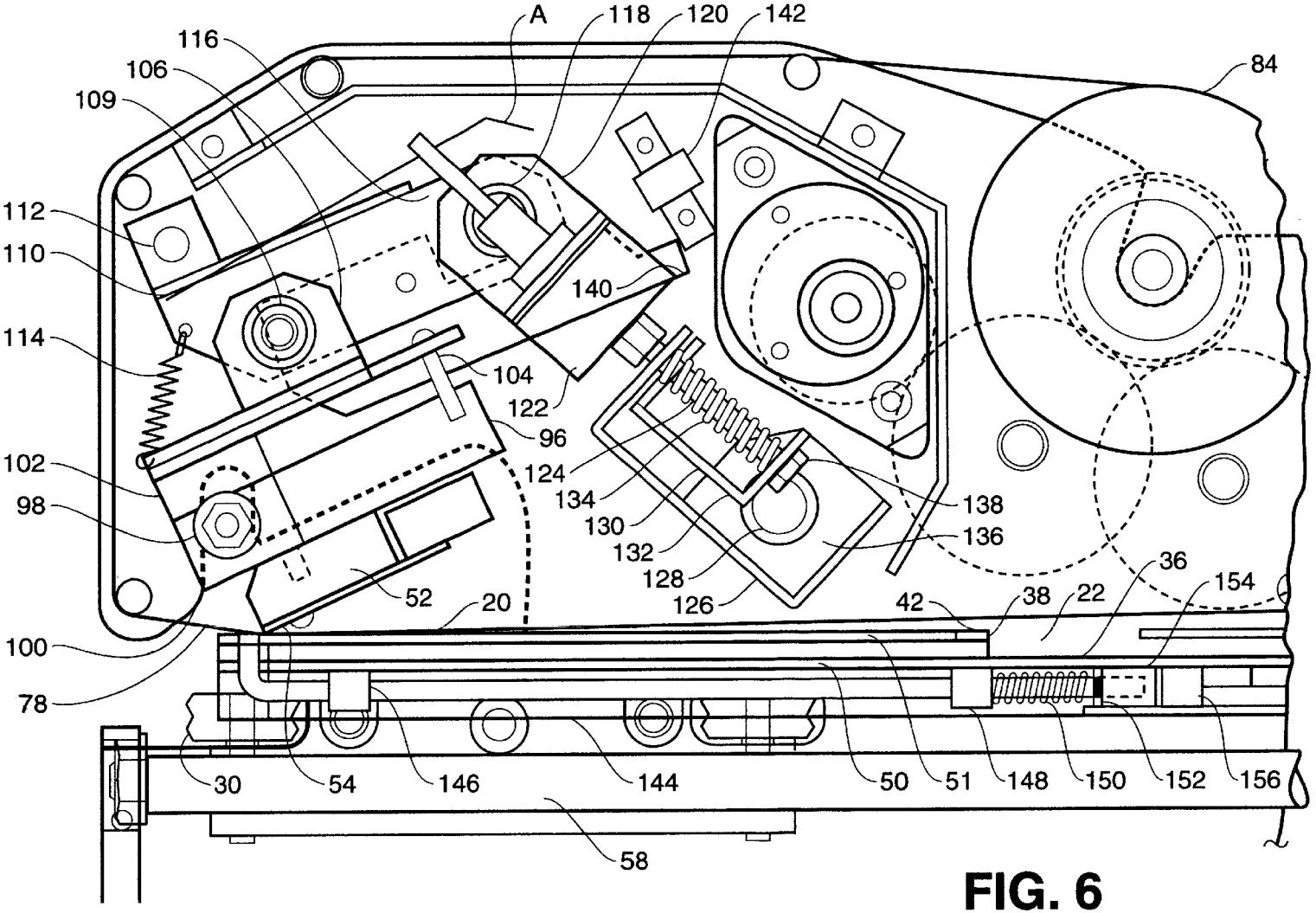
FIG. 6 is a partial side sectional view detailing a portion of the printer shown in FIG. 3.

The print head 52 is raised and lowered by the print head control mechanism 56. Referring to FIG. 6, the print head 52 is mounted on a print head carrier 96 with a carrier spindle 98 engaging a vertical slot 100 in each side wall 34 allowing limited vertical displacement. The carrier 96 is suspended in a bracket 102 spanning the spindle 98 and has an adjustment screw 104 to adjust the angle of the print head 52 relative to the tray 22. The bracket 102 has a central tab 106 that has a pivot 108 connecting the bracket 102 to a lever arm 110 that is connected to a fixed pivot pin 112. The central tab pivot 108 allows some lateral roll along the printing edge 54 of the print head 52 to distribute the force applied to the print head 52 uniformly along the contact edge 54 when applied against the media to be printed. A tension spring 114 maintains the carrier spindle 98 forward in the slot 100 to eliminate play on print head positioning.

The lever arm 110 has a distal end 116 with a pivot 118 connecting the lever arm 110 to a bracket 120 on which is mounted a motor 122 with a displaceable screw 124. The displaceable screw 124 connects the motor bracket 120 to an end bracket 126 with a pivot 128 and a spring trap 130. The spring trap 130 includes a floating bracket 132 and a compression spring 134. The motor bracket 120 and end bracket 126 form a variable length link using the displaceable screw 124 as the adjustment mechanism. When contracted, the print head is lowered to the media, here the recordable compact disk 20 and mask 42. Upon further contraction, the bracket 132 that traps the compress ion spring 134 is drawn toward the motor bracket 120 compressing the spring. The force of compression is magnified by the moment arm to pivot 112 and is translated to the contact edge 54 of the print head 52 as a controlled force against the disk 20 and mask 42.

When the variable length link is expanded, by reversing the motor and extending the displaceable screw 124, the spring trap 130 is driven to the end plate 136 where the lock nut 138 seats and the distal end 116 of the lever arm 110 is forced to rise to the position "A" as indicated in FIG. 6, thereby lifting the print head 52. A tab 140 on the lever arm 110 is detected by a photo sensor 142 to stop the motor and signal the controller that the print head 52 is in its raised position.

Figure 5:
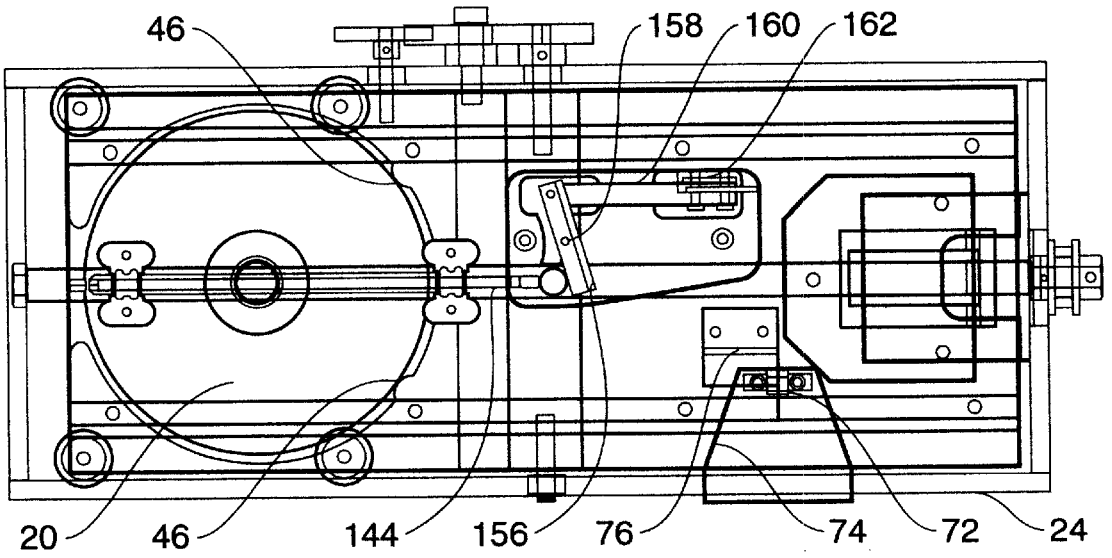
FIG. 5 is a multilevel plan view showing an actuator mechanism for a disk retainer pin.

In FIG. 6, the print head 52 is shown pressing the ribbon 78 against the compact disk 20 at the beginning of the print cycle. The contact edge 54 is positioned proximate the retainer pin 50 without contacting the pin. The pin 50 is located at the end of an actuator rod 144 slidable in a pair of bearings 146 and 148 in a hollowed out portion of the underside of the tray 22. The pin 50 is urged against the edge of the disk 20, which is pressed against the protuberances 46 at the edge of the mask 42 by a compression spring 150 compressed between one of the bearings 148 and a clip 152 on the rod 144. At the end of the rod 144 is a cylindrical cam 154 that contacts one end of a lever 156 having a center pivot pin 158, shown in FIG. 5. The other end of the lever 156 is pivotally connected to a push rod 160 having a depending flag 162 that actuates the push rod 160 and hence the actuator rod 144 for the pin 50.

When the flag 162 contacts the end wall 62 on extension of the tray 22, the push rod is urged back and the pin actuator rod 144 is urged forward by action of the lever 156.

Figure 7:
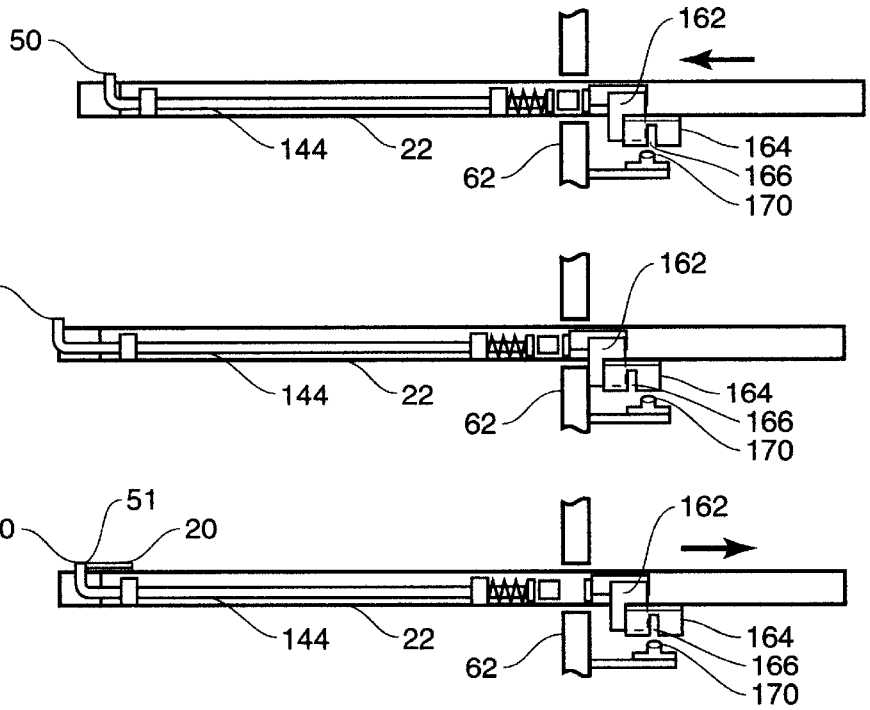
FIGS. 7A–7C are a series of schematic views of the pin actuator mechanism and a sensor for detecting disk loading conditions.

The schematic views of FIGS. 7A–7C show the movement of the actuator rod 144 as the tray 22 is extended from the end wall 62 of the printer. The flag 162, linked to the actuator rod 144, is used in conjunction with a second flag 164 with a slot 166 to detect whether a disk 20 is loaded and engaged by the pin 50. The second flag 164 is mounted to the underside of the tray. As the tray 22 extends, flag 162 is off-set from slotted flag 164 as shown in FIG. 7A. When the tray 22 reaches maximum extension as shown in FIG. 7B, the flag 162 contacts the wall 62 and is urged back alongside flag 162. In this position, slot 166 is blocked and pin 50 is advanced by lever 156 of FIG. 5 allowing a disk 20 to be deposited on the tray 22.

As the tray 22 begins to be retracted, the pin 50 returns to the position of FIG. 7A, unless the pin 50 contacts the edge of the disk 20. If a disk is present and properly engaged by the pin 50, as shown in FIG. 7C, the full return of the actuator rod 144 is halted and the slot 166 of the slotted flag 164 remains blocked by the flag 162. This blockage is detected by a photosensor 170 which is activated at a predefined tray position and a signal is sent to the controller to indicate a disk is loaded and properly seated permitting the printing cycle to commence. If a disk is not loaded or if improperly seated, with pin 50 returning to the position of FIG. 7A, then the photosensor 170 detects the uncovered slot 166 and the printing cycle will not be triggered. When the tray 22 returns to the position of FIG. 7B in the return cycle, the pin 50 is again displaced releasing the disk 20 for manual or automatic removal from the tray 22 and replacement with the next disk to be printed.

Referring again to FIG. 6, the disk 20 has a thickness matched by the mask 42 forming the mask layer. The force of the print head 52 at the start of the printing operation is largely distributed across the mask 42 on each side of the edge of the disk. The pad 38 forms the base layer and is adhered to the rigid top surface 36 of the tray 22. As the tray 22 is extended a distance equivalent to the pixel width formed by a pixel generating element 55 in the linear array, discrete thermal resistors are activated causing the ink transfer to the media in a bit-mapped pattern created by the labeling program and transferred to the printer controller as an instruction set to activate the thermal resistors.

Figure 8A:
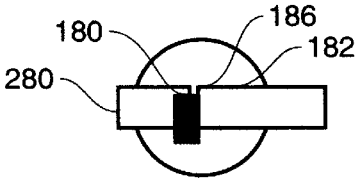
FIGS. 8A–8E are a series of schematic view of different embodiments of retainer pins.

Referring to FIGS. 8A–E, certain details relating to the holding pin are illustrated. In FIG. 8A the pin 180 is shown engaging a media item 182 adjacent a mask layer 184 displaced from the top surface 186 of the media item. In this manner the contact edge of a print head will avoid contact with the pin 180. The degree of displacement in part depends on the compressibility of an underlying base layer, and should be approximately ¼–⅓ of the media thickness.

Figure 8D:
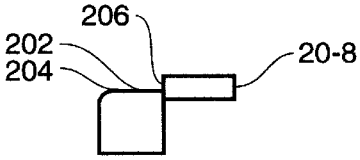
Figure 8B:
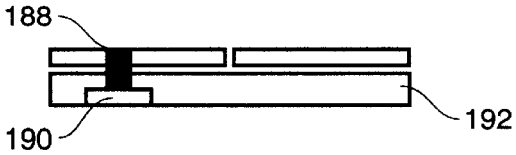

In FIG. 8B, a retaining pin 188 is shown seated on a compressible plug 190 in the base material 192. Contact with a print head will depress the pin and avoid damage to the print head.

Figure 8E:
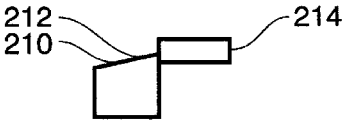
Figure 8C:
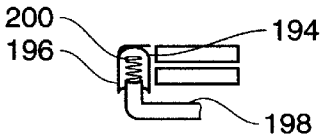

In FIG. 8C, a retaining pin 194 is in the form of a cap 196 on the end of an actuator rod 198 with a compression spring 200 allowing displacement of the pin 194 on contact with the print head.

Alternately, a pin 202 as shown in FIG. 8D has a rounded edge 204 opposite the edge 206 that contacts the media item 208. Or, as shown in FIG. 8E the pin 210 has a chamfered top 212, sloping downward and away from the contact edge with the media item 210. In each case, damage on contact by the printing head will be minimized or avoided.

Preferably, a non-conducting material is used for the pins to avoid short circuiting of the resistor elements if contacted.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A printer for printing information on compact disks comprising:

a) a frame, b) a moveable disk holding tray having an end with a portion of the tray at the end having a disk retaining means;

c) means for moving the disk holding tray between a first position, with the tray retracted within the frame, to a second position with the end portion of the tray projected from the frame;

d) printing means mounted in the frame for printing information on a disk supported on the end portion tray wherein the disk retaining means includes a mask mounted on the tray having a circular cutout, wherein the disk has an edge and a thickness, and the mask has a thickness substantially equal to the thickness of the disk, with the disk being located within the mask cutout during printing and wherein the disk retaining means also includes a retainer pin proximate the end of the tray, the retainer pin engaging the edge of the disk when the disk is located within the cutout of the mask wherein the retainer pin has means for urging the pin against the edge of the disk and wherein the actuator mechanism includes an actuator rod with a first end connected to the pin and a second end connected to a displacement means for displacing the rod and connecting pin; and e) a sensor means for sensing the position of the retainer pin.

2. The printer of claim 1 wherein the mask has a pair of spaced protuberances across the cutout from the pin to position the disk located in the cutout.

3. The printer of claim 1 wherein the actuator mechanism includes a spring, and the spring biases the pin against the edge of the disk.

4. The printer of claim 1 wherein the sensor means includes a photosensor and the photosensor senses the position of the contact member.

5. The printer of claim 4 wherein the contact member comprises a first flag connected to the linkage mechanism and the sensor means includes a second flag mounted to the tray, the second flag having a slot, wherein the blockage of the slot is detected by the photosensor and determines the position of the retainer pin.

6. In a thermal transfer printer with a print head and a disk holder tray for mounting a compact disk for printing with the print head, an improved retainer for holding the disk comprising a pin having means for minimizing damage to the print head on inadvertent contact of the pin by the pin head wherein the pin has resilient support means for vertical displacement of the pin on contact by the print head.

7. A method of uniformly distributing a substantially fixed force of a printing head in a thermal transfer printer across a media item having a non-rectangular, perimeter configuration with a perimeter edge comprising the steps of:

a) providing a flat support surface moveable relative to the printing head;

b) mounting a resilient support pad on the flat support surface;

c) mounting a mask on the resilient support pad, the mask having a cutout with a configuration that is substantially the same configuration as the non-rectangular perimeter configuration of the media item and having a thickness and compressibility that is substantially the same as the item to be printed, wherein the mask has a substantially rectangular perimeter;

d) providing a retainer pin projecting from the flat support surface proximate the perimeter edge of the media item when positioned in the cutout of the mask, wherein the mask has a small cutout to accommodate the pin:

e) positioning the media item in the cutout of the mask;

f) urging the retainer pin against the perimeter edge of the media item positioned in the cutout of the mask;

g) applying the force of the print head across both the media item and the mask when printing; and h) printing by moving the print head over the media item and the mask starting from a position adjacent the pin.

8. A printer for printing information on compact disks comprising:

a) a frame, b) a moveable disk holding tray having an end with a portion of the tray at the end having a disk retaining means;

c) means for moving the disk holding tray between a first position, with the tray retracted within the frame, to a second position with the end portion of the tray projected from the frame;

d) printing means mounted in the frame for printing information on a disk supported on the end portion tray wherein the disk retaining means includes a mask mounted on the tray having a circular cutout, wherein the disk has an edge and a thickness, and the mask has a thickness substantially equal to the thickness of the disk, with the disk being located within the mask cutout during printing and wherein the disk retaining means also includes a retainer pin proximate the end of the tray, the retainer pin engaging the edge of the disk when the disk is located within the cutout of the mask wherein the retainer pin has means for urging the pin against the edge of the disk, wherein the actuator mechanism includes an actuator rod with a first end connected to the pin and a second end connected to a displacement means for displacing the rod and connected pin and wherein the displacement means includes a linkage mechanism with a contact member and a stop, wherein, upon moving the tray to the second extended position, the contact member contacts the stop and the pin is displaced toward the end of the tray.

9. The printer of claim 8 wherein the mask has a pair of spaced protuberances across the cutout from the pin to position the disk located in the cutout.

10. The printer of claim 8 wherein the actuator mechanism includes a spring and the spring biases the pin against the edge of the disk.

* * * * *